US006652767B2

(12) United States Patent
Kazamaturi

(10) Patent No.: US 6,652,767 B2
(45) Date of Patent: Nov. 25, 2003

(54) COMPOSITION FOR PLASTIC MAGNET

(75) Inventor: Satoshi Kazamaturi, Kawaguchi (JP)

(73) Assignee: Enplas Corporation, Saitama (JP)

( * ) Notice: Subject to any disclaimer, the term of this patent is extended or adjusted under 35 U.S.C. 154(b) by 39 days.

(21) Appl. No.: 10/118,799

(22) Filed: Apr. 9, 2002

(65) Prior Publication Data

US 2002/0162987 A1 Nov. 7, 2002

(30) Foreign Application Priority Data

Apr. 9, 2001 (JP) ..... 2001-109930

(51) Int. Cl.[7] ..... H01F 1/113

(52) U.S. Cl. ..... 252/62.54; 252/62.55; 252/62.56; 252/62.57; 252/62.58; 252/62.59; 252/62.6; 252/62.61; 252/62.62; 252/62.63; 252/62.64

(58) Field of Search ..... 252/62.54, 62.55, 252/62.56, 62.57, 62.58, 62.59, 62.6, 62.61, 62.62, 62.63, 62.64

(56) References Cited

FOREIGN PATENT DOCUMENTS

EP 289979 * 11/1988
JP 2000-21615 * 1/2000
WO WO 98/50460 * 11/1998

* cited by examiner

*Primary Examiner*—C. Melissa Koslow
(74) *Attorney, Agent, or Firm*—Koda & Androlia

(57) ABSTRACT

In a composition for a plastic magnet, containing an Nd—Fe—B based alloy powder and a ferrite magnetic material powder mixed to a resin material, the Nd—Fe—B based alloy powder has particle sizes distributed in a range of 100 to 400 $\mu$m, and the ferrite magnetic material powder has an average particle size of approximately 1 $\mu$m. The weight ratio of the Nd—Fe—B based alloy powder to the ferrite magnetic material powder is in a range of 30:70 to 70:30. Further, the ratio of the total weight of the Nd—Fe—B based alloy powder 2 and the ferrite magnetic material powder 3 to the weight of the resin material is in a range of 90:10 to 80:20. Thus, in a plastic magnet 1 formed using the composition, peripheries of particles of the Nd—Fe—B based alloy powder 2 are surrounded by particles of the ferrite magnetic material powder 3 and the resin material.

2 Claims, 1 Drawing Sheet

COMPOSITION FOR PLASTIC MAGNET

BACKGROUND OF THE INVENTION

1. Field of the Invention

The present invention relates to a composition for a plastic magnet widely utilized in various sensors, measuring instruments, motors, automobile parts, electronic parts of an electromagnetic sound generator and the like, and particularly, to a composition for a plastic magnet, containing an Nd—Fe—B based alloy powder and a ferrite magnetic material powder as magnetic material powders.

2. Description of the Related Art

There are conventionally known plastic magnets, including a plastic magnet formed from a ferrite magnetic material powder and a resin (referred to as a first example for simplification), a plastic magnet formed from a rare earth metal-based magnet powder (e.g., a samarium-cobalt based alloy magnet and an Nd—Fe—B based alloy magnet) and a resin {referred to as a second example for simplification (for example, see Japanese Patent Application Laid-open No. 9-260170)}, and a plastic magnet formed from a ferrite magnetic material powder, a rare earth metal-based magnet powder and a resin {referred to as a third example for simplification (for example, see Japanese Patent Application Laid-open No. 2000-21615)}. Any of the first, second and third examples is formed by any of a compression molding process, an extruding process and an injection molding process. In recent years, an Nd—Fe—B based alloy powder having a large magnetic force has been used as the rare earth metal-based magnet powder in many cases.

The first example is inexpensive, as compared with the second example, and has such a preferred characteristic (a plus characteristic) that when it is exposed to a high temperature, the demagnetizing factor thereof is smaller than that of the second example, but has such a minus characteristic that its magnetic force smaller than that of the second example. On the other hand, the second example has such a plus characteristic that its magnetic force is larger than that of the first example, but the second example is expensive, as compared with the first example and has such a minus characteristic that its high-temperature irreversible demagnetizing factor is larger than that of the first example. Therefore, the third example having a characteristic intermediate between those of the first and second examples has been developed. When the first examples are left to stand for 6 minutes in an environment having a temperature of 150° C., the high-temperature irreversible demagnetizing factor of the first example is approximately 1%; that of the second example is approximately 6%; and that of the third example is approximately a value intermediate between those of the first and second examples.

In recent years, with automobile parts and electronic parts in which a plastic magnet is used, attempts have been made to reduce the size and weight thereof and moreover, a high quality is required. Especially, with automobile parts and electronic parts used for a long time in an environment having a high temperature, it is required to maintain the quality in the high-temperature environment, namely, it is required that the part has a durability. Therefore, with the third example having the magnetic force larger than that of the first example and capable of being reduced in size and weight more than the first example, it is required that the high-temperature irreversible demagnetizing factor of the third example is further close to that of the first example. However, the plastic magnet conventionally known as the third example merely has the nature intermediate between those of the first and second examples, and demands in the market as described above could not be met sufficiently.

SUMMARY OF THE INVENTION

Accordingly, it is an object of the present invention to provide a composition for a plastic magnet, containing an Nd—Fe—B based alloy powder, a ferrite magnetic material powder and a resin material, wherein the high-temperature irreversible demagnetizing factor of a plastic magnet formed from the composition can be reduced to smaller than those of the conventionally known plastic magnets.

To achieve the above object, according to a first aspect and feature of the present invention, there is provided a composition for a plastic magnet, containing an Nd—Fe—B based alloy powder and a ferrite magnetic material powder mixed to a resin material, wherein the Nd—Fe—B based alloy powder has particle sizes distributed in a range of 100 to 400 $\mu$m; the ferrite magnetic material powder has an average particle size equal to or smaller than 1/100 of the particle sizes of particles distributed in a largest amount in the Nd—Fe—B based alloy powder; and the weight ratio of the Nd—Fe—B based alloy powder to the ferrite magnetic material powder is in a range of 30:70 to 70:30.

With the composition having the first feature, particles of the ferrite magnetic material powder fill gaps between particles of the Nd—Fe—B based alloy powder and surround the periphery of each of the particles of the Nd—Fe—B based alloy powder. Therefore, the transfer of heat to the particles of the Nd—Fe—B based alloy powder can be made difficult by the particles of the ferrite magnetic material powder, and it is possible to exhibit a large magnetic force (intermediate between those of the first and second examples) capable of being distinctly discriminated from that of the first example. Namely, it can be expected that a plastic magnet formed using the composition according to the present invention shows a high-temperature irreversible demagnetizing factor further closer to that of the first example more than to that of the third example, and exhibits a magnetic force equivalent to or larger than that of the conventional third example. Therefore, the plastic magnet formed using the composition according to the present invention can maintain a desired magnetic force over a long period in an environment at a high temperature.

According to a second aspect and feature of the present invention, in addition to the first feature, the ratio of the total weight of the Nd—Fe—B based alloy powder and the ferrite magnetic material powder to the weight of the resin material is in a range of 90:10 to 80:20.

With the second feature, it is possible to ensure a sufficient flowability of the composition during the molding thereof, thereby easily molding the composition, and a formed plastic magnet can generate a sufficient magnetic force. Thus, it is possible to sufficiently meet the demands for the reductions in size and weight of the plastic magnet.

The above and other objects, features and advantages of the invention will become apparent from the following description of the preferred embodiment taken in conjunction with the accompanying drawings.

DESCRIPTION OF THE PREFERRED EMBODIMENT

Figure 1:
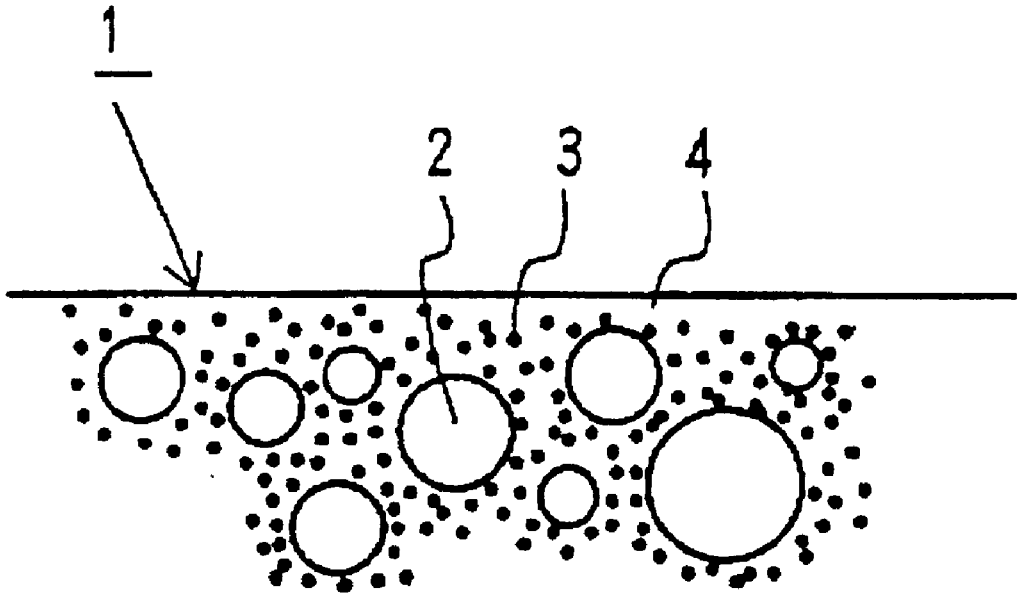
FIG. 1 is a diagram showing a microscopic structure of a plastic magnet formed using a composition according to the present invention.

The present invention will now be described by way of an embodiment with reference to the accompanying drawing.

A composition for a plastic magnet according to the present embodiment contains a resin material, an Nd—Fe—B based alloy powder, and a ferrite magnetic material powder. Selected as the resin material is an optimal material suitable for a process for forming a plastic magnet, such as an injection molding process, a compression molding process, an extruding process and the like, conditions of an environment where the plastic magnet is used, and a procedure for producing any of various electronic parts into which a plastic magnet is incorporated. For example, if a plastic magnet is to be produced by an injection molding process, 12-nylon, PA9T, 4,6-nylon and the like each of which is a polyamide-based resin material may be used. The present embodiment will be described taking the formation of a plastic magnet in the injection molding process as an example.

The Nd—Fe—B based alloy powder, which may be used, is a powder having particle sizes varied in a range of 100 to 400 $\mu$m (i.e., the largest particle size is four times the smallest particle size). On the other hand, the ferrite magnetic material powder mixed with the Nd—Fe—B based alloy powder, which may be used, is a powder having an average particle size which is equal to or smaller than 1/100 of the particle size of particles dispersed in largest amount in the Nd—Fe—B based alloy powder and which is extremely small as compared with the particles sizes of the Nd—Fe—B based alloy powder. The Nd—Fe—B based alloy powder and the ferrite magnetic material powder are mixed with each other at a mixing ratio, which may be in a range of 30:70 to 70:30 by weight, but an optimal ratio by weight is determined depending on service conditions and the like. The mixing ratio of the Nd—Fe—B based alloy powder to the ferrite magnetic material powder has been determined by experiments in the range ensuring that even if a variability in magnetic force of a plastic magnet (a first example) formed of only the ferrite magnetic material powder and a variability in magnetic force of a plastic magnet (a second example) formed of only the Nd—Fe—B based alloy powder are taken into consideration, a magnetic force characteristic capable of being distinctly discriminated from the magnetic force characteristics of the first and second examples can be exhibited.

A magnetic powder mixture resulting from the mixing of Nd—Fe—B based alloy powder and the ferrite magnetic material powder is mixed with the resin material at a mixing ratio, which may be in a range of 90:10 to 80:20 by weight, but an optimal ratio is determined depending on service conditions and the like. The ratio of the magnetic powder mixture to the resin material (in the range of 90:10 to 80:20) has been determined by experiments in the range ensuring that a composition produced using the magnetic powder mixture having the above-described particle size and the weight ratio exhibits a preferable flowability during the injection molding, and each of the magnetic powders exhibits a preferable bonding force (i.e., a produced plastic magnet has a preferable strength). The weight ratio of the magnetic powder mixture to the resin material equal to 90:10 is approximately a limit value at which the injection molding is possible. If the proportion of the resin material to the amount of the magnetic powder mixture is equal to or smaller than 1/9, the composition for the plastic magnet has a degraded flowability and hence, the injection molding of such composition is difficult. The weight ratio of the magnetic powder mixture to the resin material equal to 80:20 is approximately a limit value at which a plastic magnet having a complicated shape can be formed easily by the injection molding process and can exhibit a magnetic force as large as it is possible to meet demands for reductions in size and weight.

A process for producing a plastic magnet using a composition comprising a resin material, an Nd—Fe—B based alloy powder and a ferrite magnetic material powder as described above will be described below. First, the resin material, the Nd—Fe—B based alloy powder, the ferrite magnetic material powder and a small amount of an additive such as an antioxidant are thrown into a mixing/agitating vessel, where they are mixed sufficiently to produce a composition for a plastic magnet. Then, the composition for the plastic magnet is thrown into a kneader, where it is kneaded. Subsequently, the kneaded composition is palletized, and the palletized composition is thrown into an injection molding machine. The palletized composition thrown into the injection molding machine is heated to a temperature equal to or higher than a melting point of the resin material to provide a molten composition, which is then injected into a cavity in an injection molding die. In this manner, a plastic magnet of a desired shape is formed.

In the plastic magnet 1 formed in the above manner, particles 3 of the ferrite magnetic material powder having the extremely small particle size surround the periphery of each of particles 2 of the Nd—Fe—B based powder having the larger particle size, and the particles 2 of the Nd—Fe—B based powder and the particles 3 of the ferrite magnetic material powder are bonded to each other by the resin material 4, as shown in FIG. 1.

According to the present embodiment, the average particle size of the ferrite magnetic material powder having a small heat conductivity is equal to or smaller than 1/100 of the particle sizes of particles distributed in a largest amount in the Nd—Fe—B based alloy powder having a large high-temperature irreversible demagnetizing factor. Moreover, the weight ratio of the Nd—Fe—B based alloy powder to the ferrite magnetic material powder is limited to the range of 30:70 to 70:30 and hence, particles of the ferrite magnetic powder fill gaps between particles of the Nd—Fe—B based powder and surround the peripheries of the particles of the Nd—Fe—B based powder. Therefore, the transfer of heat to the particles of the Nd—Fe—B based powder can be made difficult by the particles of the ferrite magnetic powder having the small heat conductivity, and the plastic magnet can exhibit a large magnetic force distinctly discriminated from that of the first example (a magnetic force substantially intermediate between those of the first and second examples). Therefore, the plastic magnet formed by subjecting the composition for the plastic magnet according to the present embodiment to the injection molding, even if it is put to use in an environment at a high temperature, has a high-temperature irreversible demagnetizing factor smaller than that of the conventional third example, and thus, can exhibit a desired magnetic force characteristic over a long period and can exhibit a sufficient magnetic force, while meeting the demands for reductions in size and weight.

According to the present embodiment, the Nd—Fe—B based alloy powder having a large magnetic energy per unit volume has particle sizes distributed in the range of 100 $\mu$m to 400 $\mu$m. Therefore, the charging efficiency of the Nd—Fe—B based alloy powder per unit volume can be improved more than that of a powder having a substantially uniform particle size, and the magnetic force of a produced plastic magnet can be increased more than that of a plastic magnet formed using the powder having the substantially uniform particle size. In addition, because the particle size of the ferrite magnetic material powder is equal to or smaller than 1/100 of those of the particles distributed in the largest amount in the Nd—Fe—B based allow powder, the particles of ferrite magnetic material powder are easily filled between the Nd—Fe—B based powder particles and thus, a heat-shielding effect can be exhibited sufficiently by the ferrite magnetic material powder.

Additionally, the composition for the plastic magnet according to the present embodiment is subjected to the injection molding in order to produce the plastic magnet. Therefore, the resin material molten in the die is cooled, whereby a resinous skin layer is formed on a surface of the plastic magnet. Thus, the magnetic material powder liable to be rusted cannot be exposed to the atmospheric air and hence, a coating required to prevent the rusting of the magnetic material powder is not required.

As described above, the present invention exhibits an excellent effect, if the composition according to the present invention is utilized for producing plastic magnets used, for example, in parts employed in an environment at a high temperature such as automobile parts, electronic parts immersed in a solder tank, and other parts.

The present invention is not limited to the formation of the plastic magnet by the above-described injection molding process, and the composition according to the present invention may be used to form a plastic magnet of a desired shape by any of a compression molding process, an extruding process and the like.

What is claimed is:

1. A composition for a plastic magnet, comprising an Nd—Fe—B based alloy powder and a ferrite magnetic material powder mixed to a resin material, wherein said Nd—Fe—B based alloy powder has particle sizes distributed in a range of 100 to 400 $\mu$m; said ferrite magnetic material powder has an average particle size equal to or smaller than 1/100 of the particle sizes of particles distributed in a largest amount in said Nd—Fe—B based alloy powder; and the weight ratio of said Nd—Fe—B based alloy powder to said ferrite magnetic material powder is in a range of 30:70 to 70:30.

2. A composition for a plastic magnet according to claim 1, wherein the ratio of the total weight of said Nd—Fe—B based alloy powder and said ferrite magnetic material powder to the weight of said resin material is in a range of 90:10 to 80:20.

* * * * *